United States Patent [19]

Stannow et al.

[11] 4,118,153

[45] Oct. 3, 1978

[54] ENCAPSULATED MOTOR COMPRESSOR FOR REFRIGERATORS

[75] Inventors: Jørgen Christian Stannow, Sonderborg; Kjeld Kjeldsen, Nordborg; Hans Jürgen Tankred, Sonderborg; Per Johan Madsen, Nordborg, all of Denmark

[73] Assignee: Danfoss A/S, Nordborg, Denmark

[21] Appl. No.: 786,424

[22] Filed: Apr. 11, 1977

[30] Foreign Application Priority Data

Apr. 21, 1976 [DE] Fed. Rep. of Germany ..... 2617369

[51] Int. Cl.[2] ..... F16F 15/06; F04B 39/00

[52] U.S. Cl. ..... 417/363

[58] Field of Search ..... 417/363, 902, 415; 74/591; 62/295, 296

[56] References Cited

U.S. PATENT DOCUMENTS

| | | | |
|---|---|---|---|
| 2,059,894 | 11/1936 | Newman | 417/363 X |
| 2,583,583 | 1/1952 | Mangan | 417/902 X |
| 2,618,172 | 11/1952 | Shoup | 74/591 |
| 3,306,524 | 2/1967 | Matuki et al. | 417/363 X |

*Primary Examiner*—Carlton R. Croyle
*Assistant Examiner*—R. E. Gluck
*Attorney, Agent, or Firm*—Wayne B. Easton

[57] ABSTRACT

The invention relates to an encapsulated motor compressor assembly for refrigerators. An integrated motor compressor unit is resiliently supported inside the casing of the assembly on helical springs which engage the lower side of the stator laminations. The points of spring engagement are in a lower plane in which it is desired to prevent or minimize radial deflection of the motor compressor unit. This is accomplished by placing certain constraints on the design of the vertical motor shaft which has the usual eccentric crank for driving the compressor piston and a compensating weight for balancing the centrifugal effects of the crank. It was discovered that certain relationships between (1) the mass of the compensating weight and the spacing of its center of gravity from the shaft axis, and (2) the mass of the eccentric crank and the spacing of its center of gravity from the shaft axis, are in fact effective to minimize radial deflection of the motor compressor unit in the above referred to lower plane.

4 Claims, 4 Drawing Figures

ENCAPSULATED MOTOR COMPRESSOR FOR REFRIGERATORS

The invention relates to an encapsulated motor compressor for refrigerators comprising a vertical motor crank shaft, a compressor having a reciprocating piston, at least one compensating weight on the motor crank shaft located on the same side of the centre of gravity of the motor compressor as is the compressor, and springs engaging in a plane that extends on the side of the centre of gravity of the motor compressor opposite to that of the compressor, particularly with a compressor disposed at the top and with vertical helical compression springs for resiliently mounting the motor compressor in the capsule.

A known motor compressor of this kind comprises a four-pole motor, to the stator of which two end plates are attached. The upper end plate carries the cylinder. The lower end plate comprises three radially projecting feet with reception holes in which vertical helical compression springs are inserted. A resilient pressure tube comprises two convolutions below the motor compressor and is led out through the oil sump. The springs and the resilient pressure tube are intended to prevent oscillations that are set up in the motor compressor during starting and during operation from being freely transmitted to the wall of the capsule, allowing the wall of the capsule to vibrate and transmit them partially as conducted sound and partially as objectionable radiated noises.

For many years it has been the practice not to arrange the springs on the side of the motor opposite to the compressor. Instead, points of engagement have been preferred that are disposed in a plane between the compressor and the motor or in a plane passing through the centre of gravity of the motor compressor. However, these and other provisions have not succeeded in reducing the vibration level below a certain value.

The invention is based on the problem of reducing the vibrations in a motor compressor of the aforementioned kind.

This problem is solved according to the invention in that the spacing a of the plane of rotation of the centre of gravity of the compensating weight from the centre of gravity of the motor compressor is chosen, primarily in dependence on the product $m_a \cdot r_a$ where $m_a$ is the mass and $r_a$ the radius of rotation of the centre of gravity of the compensating weight, so that below the centre of gravity of the motor compressor a stationary plane is obtained in which the motor compressor undergoes substantially no radial deflection during operation, and that the springs engage the motor compressor substantially in this stationary plane.

This construction is based on the surprising discovery that in a motor compressor having given constructional data, every selected compensating weight can be given a spacing from the centre of gravity of the motor compressor so that a stationary plane is produced on the opposite side of the centre of gravity of the motor compressor, in which plane the deflections of the motor compressor are practically zero perpendicular to the motor axis even though the compressor itself executes movements at the frequency of the motor speed caused by the reciprocating piston drive and possibly by imbalances that are present. The springs engaging in the stationary plane are therefore practically not activated, at least by this frequency, thus producing a corresponding reduction in the vibrations. Further, the springs can be made considerably softer than hitherto because no attention need be paid to spring return forces which act against excessively large displacement of the stator transversely to the shaft. The inherent frequency of the system consisting of the motor compressor and the spring suspension can thus be reduced to such an extent that a considerable spacing is provided between the activated frequency and the inherent frequency.

If one considers the ratio $n = (m_a \cdot r_a)/(M \cdot r_k)$, wherein $m_a$ is the mass and $r_a$ the radius of rotation of the centre of gravity of the compensating weight, M is the sum of the masses of the crank pin, connecting rod and piston and $r_k$ is the eccentricity of the crank pin, then the practical useful values lie between about 0.1 and about 3.0. However, it is particularly favourable if $n$ lies between 0.3 and 1.5. With such selected values of $n$, the spacing of the rotary plane of the centre of gravity of the compensating weight from the centre of gravity of the motor compressor as is required to produce a stationary plane exceeds the spacing between the cylinder axis and the centre of gravity of the motor shaft by no more than an acceptable distance. The axial length of the motor compressor is therefore practically not increased by reason of the new suggestion.

Advantageously, $n$ is about 0.6 to 0.9 when using a single compensating weight. This compensating weight can then be arranged between the bearing and the crank pin.

When using two compensating weights of which the centre of gravity lies between these weights, $n$ should be about 0.9 to 1.1 because this will result in a comparatively short motor compressor.

In particular, the product $m_a \cdot r_a$ can be selected so that the stationary plane is disposed approximately at the underside of the stack of stator laminations and the vertical helical compression springs are arranged substantially within the projection of the stack of stator laminations. In this way one can make do with comparatively simple mountings for the springs. Also, additional space for the springs will not be required radially outside the stator.

With particular advantage, the mass $m_a$ of the compensating weight is equal to from 1 to 2 times the weight of the piston and connecting rod, preferably 1.5 times. Such dimensioning of the compensating weight related to the oscillating masses lies considerably beyond the conventional dimensions knwon for the factors below 1, e.g. 0.5. In this way one achieves that the oscillations that are still transmitted to the wall of the capsule lie below a predetermined low limiting value in all directions of activation, i.e. that excessive amplitudes of oscillation do not occur in preferred directions with a generally low level of vibration.

Further, it is favourable if the moment of inertia of the motor compressor about the y-axis parallel to the cylinder axis is less than its moment of inertia about the x-axis perpendicular thereto and to the axis of the motor crank shaft. As a result, the spacing of the stationary plane from the centre of gravity becomes smaller with an increase in $n$. By appropriately selecting $n$, one can therefore produce very short motor compressors.

It is of particular advantage if the motor is two-poled. Two-pole motors are known per se. However, in the present novel combination the duel polarity is utilised for the further reduction of the noise because, by reason of the higher rotary speed as compared with a four-pole construction, the activated frequency is higher and consequently there is an even larger spacing from the inherent frequency of the system that has been reduced with the aid of springs that are as soft as possible.

In particular, the helical compression springs can be designed to be so soft that they are compressed under the weight of the motor compressor by about half or more of the free spring deflection limited by the block abutment. These soft springs result in a particularly low resonance frequency.

In a preferred embodiment, means are provided to shorten the effective spring length in dependence on transverse deflections of the motor compressor. These means can for example consist of a paraboloidal insert engaging in each of the top and bottom of each helical compression spring. In this way one ensures that, with movement of the motor compressor in the peripheral direction, as is unavoidable during starting, the spring becomes increasingly stiffer so that even with a spring that is soft during operation there will be no excessive peripheral deflection during starting.

If the upper insert extends almost to the lower insert when the helical compression spring is loaded by the weight of the motor compressor, these inserts simultaneously form a transport abutment for vertical movement of the motor compressor.

Further, transport abutments projecting radially beyond the stator may be provided near the stationary plane. These limit radial displacement of the motor compressor during transport.

In a preferred embodiment, mountings placed on the heads of stator bolts have an annular abutment face for the helical compression spring and a substantially cylindrical extension wedged into the spring. In particular, the mountings may consist of plastics material, the paraboloidal inserts may adjoin the cylindrical extensions, and the transport abutments may be formed by collars on the mountings. Such a mounting is easy to secure, easy to connect to the spring and fulfills a plurality of functions. When effective as a transport abutment, the plastics material absorbs energy by deformation and prevents the creation of metal shavings.

In a further embodiment, it is ensured that the pressure tube extends above the oil sump and is softer in all three directions of the coordinates by the formation of at least two rectangular loops of which the planes are substantially perpendicular to each other and extend no more than 45° to the vertical. The pressure tube is connected at a point which executes comparatively large deflections. The large degree of softness of the pressure tube in this way prevents louder noises from being transmitted to the wall of the capsule. The position above the oil sump ensures that sound oscillations are not transmitted to the wall of the capsule through the oil.

The invention will now be described in more detail with reference to an example illustrated in the drawing, wherein.

Figure 1:
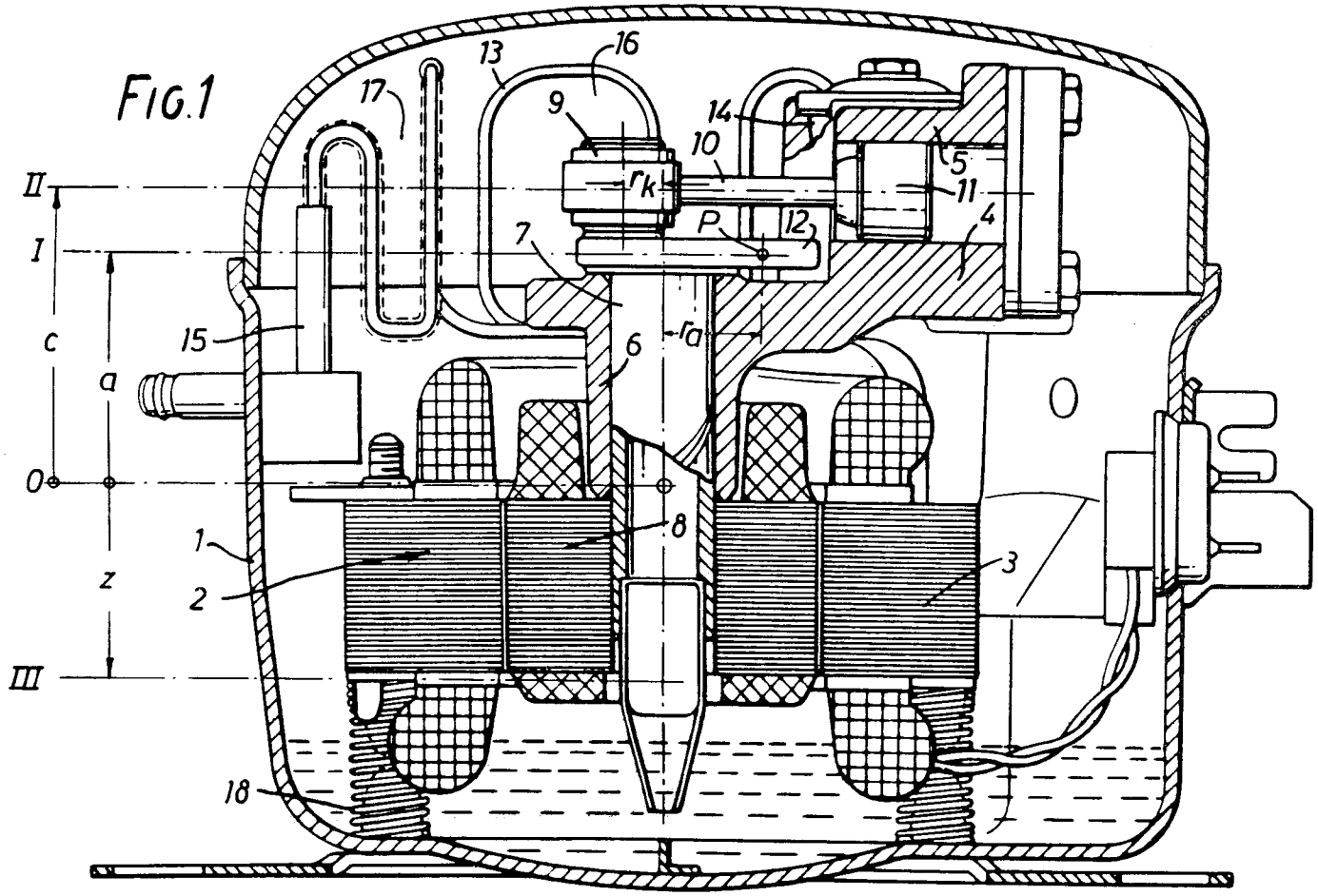
FIG. 1 is a vertical section through an encapsulated motor compressor according to the invention.

A motor compressor 2 is arranged in a capsule 1. Secured to a stator 3 there is a structural element 4 having a cylinder 5 and a bearing 6. In this bearing there is held a motor shaft 7 which carries a rotor 8 and drives a piston 11 by way of a crank 9 and a connecting rod 10. A compensating weight 12 is applied to the shaft 7 between the crank pin and bearing.

A pressure tube 13 extends from a compression sound damping chamber 14 to an outlet connection 15. The pressure tube comprises a first substantially rectangular loop 16 of which the plane is inclined by about 20° to 30° to the plane of the drawing. A second loop 17 has a substantially vertically extending plane. By reason of the many straight sections and the loop forms, this pressure tube is very soft in all three coordinates.

The motor compressor is supported by means of four helical compression springs 18 which extend between the base of the capsule and the underside of the stator 3. Securing is effected by an upper mounting 19 and a lower mounting 20, each of which comprises a collar 21, 21' having an abutment face for the spring 18, a cylindrical insert 22, 22' on which the ends of the springs are wedged, and a paraboloidal extension 23, 23'. The upper mounting 19 comprises a depression 24 so that the mounting can be placed on the head 25 of a stator bolt 26. The mounting 20 consists of metal and is welded to the base of the capsule 1. The collar 21 has a portion of its periphery projecting beyond the stator 3. The mounting 19 can consist of a comparatively soft plastics material such as tetrafluoroethylene which is resistant to refrigerant. The two ends of the paraboloidal extensions 23 and 23' are spaced apart by a small distance so that they serve as a transport abutment during vertical motion of the motor compressor. If excessive radial motion of the motor compressor occurs during transport, the projecting parts of the collars 21 make contact with the wall of the capsule and therefore also serve as a transport abutment.

In FIG. 1, the centre of gravity S of the motor compressor is indicated with the associated plane O of the centre of gravity. The centre of gravity P of the compensating weight is spaced from the motor axis by a distance $r_a$. The rotary path of this centre of gravity P lies in a plane I spaced by a distance a from the plane O of the centre of gravity. The eccentricity of the crank pin amounts to $r_k$; the cylinder axis determines a plane II spaced by a distance c from the plane O of the centre of gravity. The abutment face of the collars 21 is disposed somewhat below the stack of stator laminations and defines a plane that has been entered in FIG. 1 as the stationary plane III; it has a spacing $z$ from the plane O of the centre of gravity.

Figure 2:
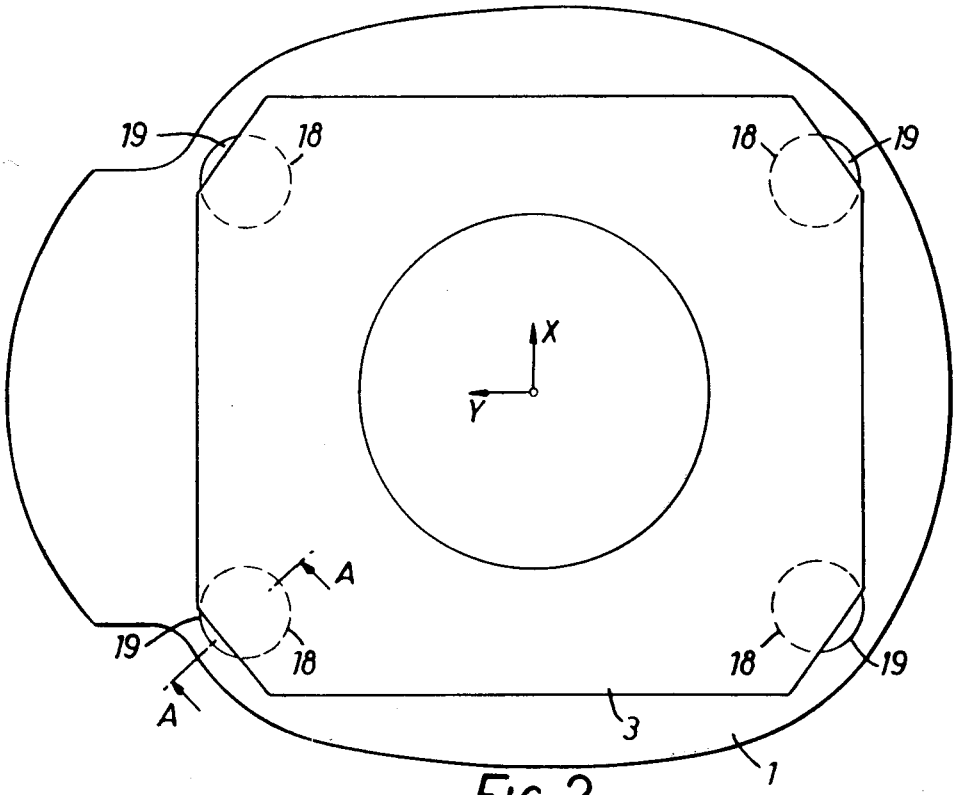
FIG. 2 is a diagrammatic plan view of the stator in the capsule.
Figure 3:
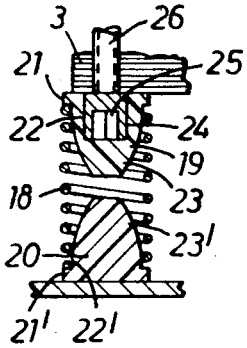
FIG. 3 is a section on the line A—A in FIG. 2.
Figure 4:
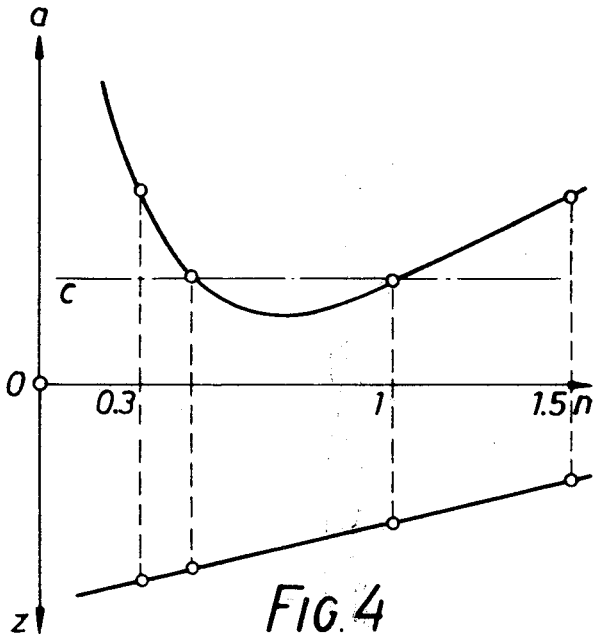
FIG. 4 is a diagram showing the spacing a of the plane of rotation of the centre of gravity of the compensating weight and the spacing $z$ of the stationary plane $z$ from the plane O of the centre of gravity of the motor compressor.

FIG. 4 shows a diagram in which the abscissa represents the position of the plane O of the centre of gravity. On the abscissa, the spacing a has been entered in the upward direction and the spacing $z$ in the downward direction. In a given motor compressor, the spacing $c$ to the cylinder axis is prescribed. The ratio $n = (m_a \cdot r_a)/M \cdot r_k)$ has been entered along the ordinate, wherein $m_a$ is the mass and $r_a$ the radius of rotation of the centre of gravity of the compensating weight 12, M is the sum of the masses of the crank pin 9, connecting rod 10 and piston 11 and $r_k$ is the eccentricity of the crank pin. As will be evident from the diagram, for each value of n there is a value a at which a stationary plane is produced at a definite spacing $z$. The illustrated inclination of the characteristic line for $z$ is obtained when the moment of inertia of the motor compressor about the x-axis is larger than that about the $y$-axis (see FIG. 2). The curves can be determined for a given motor compressor by means of experiments or by calculation. The given range of $n = 0.3$ to 1.5 ensures that the spacing a does not become too large and consequently the part of the motor compressor projecting beyond the bearing 6 does not become too long. In order that the axial length does not become too large in the downward direction, i.e. to keep the spacing z as small as possible, one should in the case of this embodiment work in the right-hand zone of the diagram in the vicinity of $n = 1$. However, one can achieve this exactly only when there are two compensating rates provided to both sides of the crank pin because no compensating weight can be applied at the spacing c at the level of the crank pin. In an embodiment with only one compensating weight, values of $n$ of 0.7 to 0.9 are recommended because then the spacing $a$ is just enough for the compensating weight to be disposed between the bearing and the crank pin.

In such a construction one can use extraordinarily soft springs. With a motor compressor having a volume of stroke of about 5.5 $cm^3$ and a weight of somewhat more than 4 kg, for which one hitherto required springs with a spring constant of 0.35 to 0.4 kp/mm, one can now use a spring constant of 0.1 kp/mm. This means, however, that instead of the springs being compressd by about 3 mm as hitherto, they are now compressed by about 10 mm. This softness is permissible because radial movements of the springs as a result of the arrangement in the stationary position do not occur during operation and because during unavoidable displacement in the peripheral direction during starting become increasingly stiffer with an increase in deflection by reason of convolutions abutting against the paraboloidal extensions 23, 23'. Deflections during transport are limited by transport abutments. As a whole, this provision alone enabled the vibration level in a motor compressor to be reduced to one eighth.

We claim:

1. An encapsulated motor compressor for refrigerators, comprising, an integrated motor and compressor unit with a lower motor part and an upper compressor part, said upper compressor part including a piston and a connecting rod, said unit having a center of gravity in a reference plane, said unit including a vertical motor crank shaft with a crank pin in a first plane at the upper end thereof, said crank pin being connected to said connecting rod, said crank pin and said connecting rod and piston having a mass $M$ with a center of gravity spaced $r_k$ from the axis of said shaft, at least one compensating weight on said shaft in a second plane on the same side of said reference plane as said compressor part, said compensating weight having a mass $m_a$ with a center of gravity spaced $r_a$ from the axis of said shaft, said second plane being spaced a distance $a$ from said reference plane, helical springs for resiliently mounting said unit, said springs engaging said unit in a third plane on the opposite side of said reference plane relative to said compressor part, said third plane being spaced a distance Z from said reference plane, the product $m_a \cdot r_a$ being scaled so that said unit has its minimal radial deflection in said third plane.

2. A motor compressor according to claim 1 wherein the ratio $n$ for $(m_a \cdot r_a)/(M \cdot r_k)$. is in the range 0.3 to 1.5.

3. A motor compressor according to claim 2 wherein there is only one said compensating weight, said ratio $n$ being in the range 0.6 to 0.9.

4. A motor compressor according to claim 1 wherein said motor part includes a stack of stator laminations, said third plane coincides substantially with the bottom of said stack of laminations.

* * * * *